US011479282B2

(12) United States Patent
Alonso Garrido et al.

(10) Patent No.: US 11,479,282 B2
(45) Date of Patent: Oct. 25, 2022

(54) METHOD, VEHICLE DEVICE AND CONTROLLER FOR OPERATING A TRACK-BOUND TRAFFIC SYSTEM

(71) Applicant: SIEMENS MOBILITY GMBH, Munich (DE)

(72) Inventors: Oscar Alonso Garrido, Tres Cantos (ES); Peter Luehrs, Braunschweig (DE); Karsten Rahn, Cremlingen (DE)

(73) Assignee: Siemens Mobility GmbH, Munich (DE)

( * ) Notice: Subject to any disclaimer, the term of this patent is extended or adjusted under 35 U.S.C. 154(b) by 387 days.

(21) Appl. No.: 16/622,433

(22) PCT Filed: May 14, 2018

(86) PCT No.: PCT/EP2018/062287
§ 371 (c)(1),
(2) Date: Dec. 13, 2019

(87) PCT Pub. No.: WO2018/228759
PCT Pub. Date: Dec. 20, 2018

(65) Prior Publication Data

US 2020/0207390 A1 Jul. 2, 2020

(30) Foreign Application Priority Data

Jun. 13, 2017 (DE) ..... 102017209928.3

(51) Int. Cl.
*B61L 25/02* (2006.01)
*B61L 27/70* (2022.01)
*B61L 27/20* (2022.01)

(52) U.S. Cl.
CPC ..... *B61L 25/023* (2013.01); *B61L 25/025* (2013.01); *B61L 27/70* (2022.01); *B61L 2027/202* (2022.01); *B61L 2205/00* (2013.01)

(58) Field of Classification Search
CPC .... B61L 1/16; B61L 1/18; B61L 3/121; B61L 25/023; B61L 25/025; B61L 27/70; B61L 2027/202; B61L 2205/00
See application file for complete search history.

(56) References Cited

U.S. PATENT DOCUMENTS 5,036,478 A * 7/1991 MacDougall ..... B61L 1/16 702/158
6,511,023 B2 * 1/2003 Harland ..... B61L 29/284 246/124

(Continued)

FOREIGN PATENT DOCUMENTS

CN 103192854 A 7/2013
CN 103476661 A 12/2013

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A method operates a track-bound traffic system which in a particularly efficient manner and at the same time with a comparably low degree of complexity allows the position of at least one vehicle end of a track-bound vehicle to be ascertained. For this purpose, the method is carried out such that a track-side device transmits first information which directly or indirectly characterizes the location of the track-side device and second information which directly or indirectly characterizes the travel direction of a track-bound vehicle. The first and second information is received by the track-bound vehicle at the location of the track-side device; and a position of at least one vehicle end of the track-bound vehicle is ascertained by the track-bound vehicle on the basis of the received first and second information.

15 Claims, 2 Drawing Sheets

(56) References Cited

U.S. PATENT DOCUMENTS

| | | | |
|---|---|---|---|
| 9,162,689 | B2 | 10/2015 | Itagaki et al. |
| 9,227,641 | B2 | 1/2016 | Schwellnus et al. |
| 10,457,300 | B2 | 10/2019 | Rahn |
| 2014/0326835 | A1 | 11/2014 | Schwellnus et al. |
| 2018/0162427 | A1 | 6/2018 | Driemel et al. |

FOREIGN PATENT DOCUMENTS

| | | | | |
|---|---|---|---|---|
| CN | 103906668 | A | 7/2014 | |
| CN | 105358402 | A | 2/2016 | |
| DE | 102011002772 | A1 | 7/2012 | |
| DE | 102013101927 | A1 * | 8/2014 | ..... B61L 15/0054 |
| DE | 102015204356 | A1 | 9/2016 | |
| DE | 102015204769 | A1 | 9/2016 | |
| DE | 102015210427 | A1 | 12/2016 | |
| EP | 1612118 | A2 | 1/2006 | |
| JP | 2015123931 | A | 7/2015 | |
| WO | WO 2004106133 | A2 | 12/2004 | |
| WO | 2012139915 | A1 | 10/2012 | |
| WO | 2015152366 | A1 | 10/2015 | |

* cited by examiner

METHOD, VEHICLE DEVICE AND CONTROLLER FOR OPERATING A TRACK-BOUND TRAFFIC SYSTEM

BACKGROUND OF THE INVENTION

Field of the Invention

Rail-borne traffic systems usually use train control systems or rather train protection systems within the scope of operating the rail-borne vehicles that run within said transport systems and that may be configured by way of example as railway vehicles, magnetic levitation trains or also rail-guided vehicles having rubber tyres. In the case of rail-borne vehicles in the form of railway vehicles, it is possible for an appropriate system to be by way of example a communication-based train control system that is also described as a CBTC (communications-based train control) system. It is of fundamental importance for a high-performance operation in such a system to determine the position of the vehicle ends of the respective rail-borne vehicle. For this purpose, it is known to use by way of example in conjunction with the European train control system ETCS (European train control system) track-side devices in a known position in the form of balises as reference points for determining the position of railway vehicles. On the basis of determining an appropriate absolute position of the relevant vehicle or rather of its vehicle ends, it is then possible to determine a relative position by way of example using an appropriate odometer, possibly in the form of a distance pulse generator.

It is usually necessary, particularly when starting the operation of a vehicle, that the relevant vehicle passes two balises so as to render it possible for the vehicle to determine the position of the vehicle ends of the vehicle. Although it is in fact already possible with reference to detecting a balise to roughly estimate the location of the rail-borne vehicle, it is however not possible in this case to determine the precise position of the vehicle ends of the vehicle since data relating to the direction of travel of the track-born vehicle is only provided when the vehicle passes a second balise.

SUMMARY OF THE INVENTION

It is the object of the present invention to provide a method for operating a rail-borne traffic system that renders it possible to determine the position at least of one vehicle end of a rail-borne vehicle in a manner that is particularly efficient and that simultaneously may be realized with a comparatively small outlay.

This object is achieved in accordance with the invention by means of a method for operating a rail-borne traffic system, wherein a track-side device transmits a first piece of information that indirectly or directly identifies the location of the track-side device and also a second piece of information that indirectly or directly identifies the direction of travel of a rail-borne vehicle; the first and second pieces of information are received by means of the rail-borne vehicle at the location of the track-side device and on the basis of the received first and second pieces of information the rail-borne vehicle determines the position at least of one vehicle end of the rail-borne vehicle.

In accordance with the first feature of the method in accordance with the invention, a track-side device transmits a first piece of information that indirectly or directly identifies the location of the track-side device and also a second piece of information that indirectly or directly identifies the direction of travel of a rail-borne vehicle. In this case, the terms "indirectly" and "directly" are to be understood to mean that on the one hand the first piece of information may directly include data relating to the location of the track-side device or rather may be formed by means of said data and in a similar manner the second piece of information may directly include data relating to the direction of travel of the rail-borne vehicle or rather may be formed by means of said data. On the other hand, it is however also possible that the first piece of information does not include directly the location of the track-side device but rather in lieu thereof includes information that renders it possible for the rail-borne vehicle to determine the location of the track-side device. Relevant information may be by way of example an explicit identity of the track-side device with reference to which it is possible for the rail-borne vehicle by means of an appropriate database, possibly in the form of a track map, to determine or rather read out the position of the track-side device. It is likewise also possible with respect to the second piece of information that said second piece of information does not explicitly specify the direction of travel of the rail-borne vehicle but rather in lieu thereof includes information that renders it possible for the rail-borne vehicle to determine the direction of travel of the rail-borne vehicle, where appropriate by means of using further information or rather data.

In accordance with the second step of the method in accordance with the invention, the first and the second pieces of information are received by means of the rail-borne vehicle at the location of the track-side device. By virtue of the fact that the rail-borne vehicle receives the first and the second piece of information at the location of the track-side device, it is hereby ensured that the first and the second pieces of information are received at a clearly specified, pre-determined location.

In accordance with the third feature of the method in accordance with the invention, it is possible in this case for the rail-borne vehicle to determine the position at least of one vehicle end of the rail-borne vehicle on the basis of the received first and second pieces of information. In addition to the first and the second pieces of information or rather the data that is derived therefrom regarding the location of the track-side device and also regarding the direction of travel of the rail-borne vehicle, it is possible in this case for the rail-borne vehicle to use other pieces of information or rather variables. Said information or data may be by way of example geometric data or rather parameters that specify the distance between a receiving device or rather a reader, which is on-board the rail-borne vehicle for receiving the first and the second pieces of information, and the respective vehicle end of the rail-borne vehicle. It is to be noted in this connection that within the scope of the method in accordance with the invention generally the position of the two vehicle ends of the rail-borne vehicle is to be determined. However, it is possible depending upon the respective circumstances that the situation arises that only the position of one of the two vehicle ends is determined, in other words either the front end of the vehicle when viewed in the direction of travel or the rear end of the vehicle when viewed in the direction of travel.

The method in accordance with the invention comprises the fundamental advantage that, as soon as the rail-borne vehicle passes only one track-side device, said rail-borne vehicle is able to determine its position precisely and also with respect to the direction of travel of the rail-borne vehicle clearly. As a consequence, it is advantageously possible for the rail-borne vehicle to rapidly start or rather start up an automated operation. As a result, this leads to an increased performance of the rail-borne traffic system and operational procedures may be accelerated and simplified. In this case, the method in accordance with the invention may be realized with a comparatively small outlay since even one single track-side device is sufficient for determining the at least one vehicle end of the rail-borne vehicle.

The method in accordance with the invention may fundamentally be used in conjunction with any type of rail-borne traffic systems. An appropriate traffic system may preferably be in this case a railway system that is operated using a CBTC system. The method in accordance with the invention may be performed or rather used in particular in special situations, in other words by way of example when the rail-borne vehicle or rather the rail-borne traffic system starts a travel operation.

Within the scope of the method in accordance with the invention, it is fundamentally possible for the track-side device to be any type of track-side device. It is only essential in this case that the track-side device transmits the first and second pieces of information at the location of the track-side device. This means that by using suitable technical measures it is to be ensured that the rail-borne vehicle is not able to receive the first and second pieces of information when said rail-borne vehicle is a distance away from the track-side device since this could lead to the position of the at least one vehicle end of the rail-borne vehicle being determined in an inadmissibly inaccurate manner. With regard to this aspect, the track-side device may be by way of example a track coupling coil, a transponder, possibly in the form of an RFID tag, or also a short-range radio transmitter. In the latter case, the appropriate radio transmitter may be configured depending upon the respective circumstances by way of example in such a manner that said short-range radio transmitter has a range in the magnitude of only 1 meter.

In accordance with a particularly preferred further development of the method in accordance with the invention, the first and second pieces of information are transmitted by a track-side device in the form of a balise. This is advantageous since balises are track-side devices that have been operationally tried and tested and are comparatively cost-efficient for transmitting information to a rail-borne vehicle. In this case, appropriate balises are used both in the case of rail-borne traffic systems of long-distance traffic, such as by way of example the European train control system ETCS and also in the case of train control systems for short-distance traffic, in other words by way of example metro systems.

It is preferred that the method in accordance with the invention may also be further developed in such a manner that the first and second pieces of information are transmitted by a track-side device that is arranged in a first track section at a distance from an adjacent second track section, wherein the distance is dimensioned such that, in the case of a direction of travel of the rail-borne vehicle from the first track section in the direction toward the second track section, the second track section is not occupied by the rail-borne vehicle at the moment the first and second pieces of information are received, whereas in the case of a direction of travel of the rail-borne vehicle from the second track section in the direction toward the first track section the second track section is occupied by the rail-borne vehicle at the moment the first and the second pieces of information are received, and the second piece of information is determined on the basis of track clear signalling information in relation to at least the second track section. This embodiment of the method in accordance with the invention has the advantage that with reference to the track clear signalling information in relation to the second track section the second piece of information may be determined in a manner which involves a comparatively small outlay and yet is reliable. It is thus advantageously possible, on account of the arrangement of the track-side device with regard to the first track section and the second track section, to derive from the track clear signalling information that relates to the second track section data relating to the direction of travel of the rail-borne vehicle.

It is thus furthermore possible to further develop the method in accordance with the invention in such a manner that the track clear signalling information identifies that the second track section is clear of rail-borne vehicles and on the basis thereof the track-side device transmits a second piece of information that indicates a direction of travel of the rail-borne vehicle from the first track section in the direction toward the second track section. It is also possible in this case for the second piece of information to indirectly or directly indicate the direction of travel of the rail-borne vehicle. Irrespective thereof, it is in so doing clearly established with reference to the information "the second track section is clear" that the rail-borne vehicle is moving in a direction of travel from the first track section in the direction toward the second track section. In the form of a plausibility check for detecting possible errors, it is possible in this case that the occupancy status of the first track section is also transmitted to the rail-borne vehicle with the second piece of information. Since the rail-borne vehicle itself is in the relevant situation in the first track section, the second piece of information should in this case identify the first track section as being occupied.

For the case that the second track section is occupied, it is perhaps not possible to clearly determine the direction of travel of the rail-borne vehicle. It is thus possible depending upon the respective circumstances for the situation to arise in which it is not possible to clearly decide whether the second track section is occupied by the rail-borne vehicle itself or rather by another rail-borne vehicle. Therefore, the previously mentioned preferred further development of the method in accordance with the invention is particularly suitable for those lengths of track along which a vehicle usually only travels in one direction of travel, in other words unidirectional.

It is preferred that the method in accordance with the invention may moreover be configured in such a manner that the track clear signalling information is transmitted to a track-side electronic unit by a track clear signalling system that comprises at least the second track section and the track-side electronic unit causes the track-side device to transmit the second piece of information. This embodiment of the method in accordance with the invention is advantageous to the extent that appropriate track-side electronic units, also referred to as LEU (lineside electronic unit), are known as such and in conjunction with so-called transparent data balises, which in a manner controlled by means of the track-side electronic unit are able to transmit different telegrams, are used by way of example in the case of ETCS. For this purpose, the track-side device possibly in the form of a balise is controlled by the track-side electronic unit in such a manner that a telegram is transmitted that comprises the respective second piece of information in the form of the respective direction of travel or rather said telegram comprises data which renders it possible for the track-side device to determine the direction of travel of the rail-borne vehicle itself. For this purpose, the track clear signalling system that comprises the at least second track section indirectly or directly transmits track clear signalling information in relation to the second track-section to the track-side electronic unit that then uses this information in the form of the second piece of information for controlling the trackside device.

With regard to the origin of the second piece of information that is transmitted by the track-side device, it is to be noted that also modern communication-based systems for controlling and protecting traffic systems, by way of example in the form of CBTC systems, frequently comprise a track clear signalling system at least as a fail-safe option. The same may apply regarding system limits, by way of example regarding depots or lengths of track using other train protection systems in order to render it possible to start up trains by way of example into the CBTC operation at these system limits. It is advantageously possible to use appropriate track clear signalling systems within the scope of the method in accordance with the invention, wherein the method in accordance with the invention may be performed or used in particular also in special situations, in other words by way of example when starting up a travel operation after a malfunction.

In accordance with a further preferred embodiment of the method in accordance with the invention, the track sections of the track clear signalling system are formed by means of axle counters or railway track circuits. This is advantageous since the axle counters and railway track circuits are conventional components of appropriate track clear signalling systems.

As an alternative to the previously mentioned embodiments, the method in accordance with the invention may also be further developed in such a manner that the direction of travel of the rail-borne vehicle is detected by a track-side sensor device and the detected direction of travel is transmitted indirectly or directly to the trackside device by the track-side sensor device. The track-side sensor device may be by way of example a two-channel wheel sensor that is configured so as to detect directions, a detection device that functions using photoelectric barriers or also a device arrangement having one or multiple directed RFID tags or rather RFID sensors that are direction-dependent and thus render it possible to determine the direction of travel of the rail-borne vehicle.

It is preferred that the method in accordance with the invention may also be configured in such a manner that the rail-borne vehicle transmits the position of the at least one vehicle end to a track-side control device of the rail-borne traffic system. This provides the advantage that the relevant information may be subsequently used by the track-side control device within the scope of the operation of the rail-borne traffic system.

In accordance with a further particularly preferred further development of the method in accordance with the invention, the position of the at least one vehicle end of the rail-borne vehicle is taken into consideration by the track-side control device when controlling and/or protecting the rail-borne vehicle. This is advantageous since as a consequence it is possible to realize a high performance operation of the rail-borne vehicle and/or of the rail-borne traffic system.

In accordance with a further particularly preferred embodiment of the method in accordance with the invention, this may occur in particular in such a manner that, in the case of a rail-borne vehicle in the form of a railway vehicle, track sections in the form of railway track sections and a track-side control device in the form of a control device of a communication-based train control system, whilst taking into consideration the position of the at least one vehicle end of the rail-borne vehicle the track-side control device 40 determines movement authority for the rail-borne vehicle and/or causes the rail-borne vehicle to change over into a moving-block operation. This is advantageous since when an appropriate movement authority is determined and/or the rail-borne vehicle changes over into or rather starts a moving-block operation, it is possible as such to realize a high-performance operation of the rail-born vehicle and consequently also of the rail-borne traffic system.

The present invention further relates to a vehicle device for a rail-borne vehicle of a rail-borne traffic system.

With respect to the vehicle device, the object of the present invention is to propose a vehicle device for a rail-borne vehicle of a rail-borne traffic system which renders it possible to determine the position at least of one vehicle end of the rail-borne vehicle in a manner which is particularly efficient and may be simultaneously realized with a comparatively small outlay.

This object is achieved in accordance with the invention by means of a vehicle device for a rail-borne vehicle of a rail-borne traffic system, having a vehicle-side receiving device for receiving a first piece of information that indirectly or directly identifies the location of a track-side device and also a second piece of information that indirectly or directly identifies the direction of travel of the rail-borne vehicle from the track-side device, and having a vehicle-side control device for determining the position at least of one vehicle end of the rail-borne vehicle on the basis of the received first piece and second piece of information.

The advantages of the vehicle device in accordance with the invention correspond essentially to those of the method in accordance with the invention with the result that in this regard reference is made to the corresponding statements above.

The invention furthermore comprises a control device arrangement for a rail-borne traffic system, having a vehicle device in accordance with the invention and also having the track-side device that is configured so as to transmit the first piece of information that indirectly or directly identifies the location of the track-side device and also the second piece of information that indirectly or directly identifies the direction of travel of the rail-borne vehicle.

Also with respect to the advantages of the control device arrangement in accordance with the invention, reference is made to the corresponding statements in conjunction with the method in accordance with the invention. Furthermore, the advantages of the further preferred further developments of the control device arrangement in accordance with the invention that are mentioned below also correspond to those of the corresponding preferred further development of the method in accordance with the invention with the result that reference is also made in this regard to the corresponding explanations above.

It is preferred that the control device arrangement in accordance with the invention may be further developed in such a manner that the track-side device is a balise.

In accordance with a further particularly preferred embodiment, the control device arrangement in accordance with the invention is configured in such a manner that the track-side device is arranged in a first track section at a distance from an adjacent second track section, wherein the distance is dimensioned such that, in the case of a direction of travel of the rail-borne vehicle from the first track section in the direction toward the second track section, the second track section is not occupied by the rail-borne vehicle at the moment the first and second pieces of information are received, whereas, in the case of a direction of travel of the rail-borne vehicle from the second track section in the direction toward the first track section, the second track section is occupied by the rail-borne vehicle at the moment the first and the second pieces of information are received, and the control device arrangement is configured so as to determine the second piece of information on the basis of track clear signalling information in relation to at least the second track section.

It is preferred that the control device arrangement in accordance with the invention may also be configured in such a manner that the track clear signalling information identifies that the second track section is clear of rail-borne vehicles and the track-side device is configured so as to transmit a second piece of information that indicates a direction of travel of the rail-borne vehicle from the first track section in the direction toward the second track section.

In accordance with a further particularly preferred embodiment of the control device arrangement in accordance with the invention, a track-side electronic unit is provided for receiving the track clear signalling information from a track clear signalling system that comprises at least the second track section and the track-side electronic unit is configured in such a manner that said electronic unit causes the track-side device to transmit the second piece of information.

It is preferred that the control device arrangement in accordance with the invention may also be further developed in such a manner that a track-side sensor device is provided for detecting the direction of travel of the rail-borne vehicle and the control device arrangement is configured in such a manner that the track-side sensor device transmits the detected direction of travel indirectly or directly to the track-side device.

The invention furthermore comprises a rail-borne traffic system having a control device arrangement in accordance with the invention or rather a control device arrangement in accordance with one of the previously described preferred further developments of the control device arrangement in accordance with the invention and also having the rail-borne vehicle.

BRIEF DESCRIPTION OF THE SEVERAL VIEWS OF THE DRAWING

The invention is further explained below with reference to exemplary embodiments. In the drawings.

DESCRIPTION OF THE INVENTION

Figure 1:
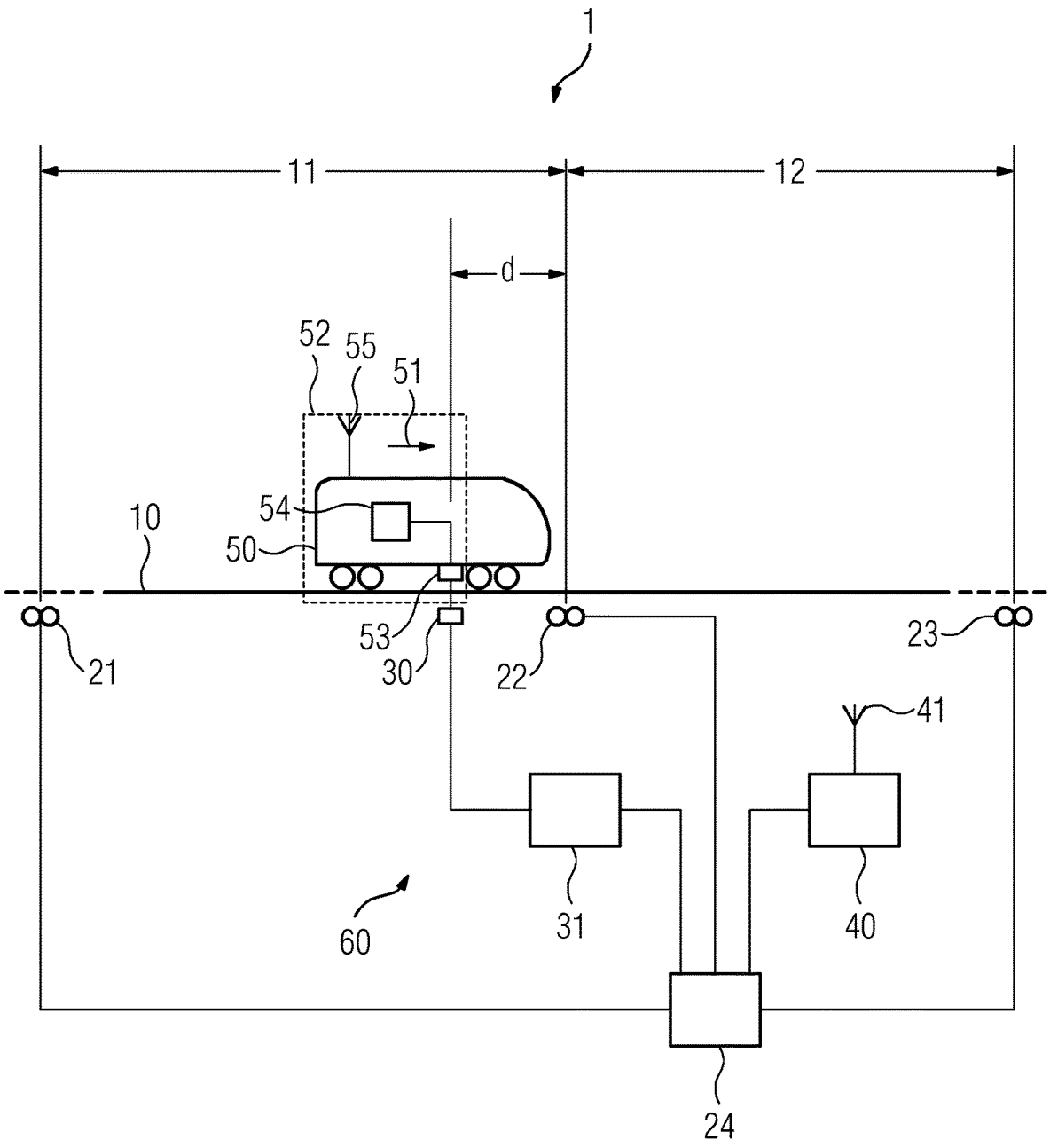
FIG. 1 shows in a first schematic sketch for explaining a first exemplary embodiment of the method in accordance with the invention a first exemplary embodiment of the rail-borne traffic system in accordance with the invention having a first exemplary embodiment of the vehicle device in accordance with the invention and also a first exemplary embodiment of the control device in accordance with the invention and FIG. 2 shows in a second schematic sketch for explaining a second exemplary embodiment of the method in accordance with the invention a second exemplary embodiment of the rail-born traffic system in accordance with the invention having a second exemplary embodiment of the vehicle device in accordance with the invention and also a second exemplary embodiment of the control device arrangement in accordance with the invention.

For reasons of clarity, the same reference numerals are used for like components in the figures.

FIG. 1 illustrates in a first schematic sketch for explaining a first exemplary embodiment of the method in accordance with the invention a first exemplary embodiment of the rail-borne traffic system in accordance with the invention having a first exemplary embodiment of the vehicle device in accordance with the invention and also a first exemplary embodiment of the control device in accordance with the invention. In detail, in this case a rail-borne traffic system 1 is apparent that comprises a length of track 10 that is configured within the scope of the present exemplary embodiment as a railway track. This means that within the scope of the exemplary embodiment the rail-borne traffic system 1 is a railway system.

The length of track 10 is divided into a first track section 11 and a second track section 12, wherein the two track sections 11, 12 are delimited by means of wheel sensors or rather by means of axle counters 21, 22 and 23. The axle counters 21, 22, 23 are a component of a railway track clear signalling system and within the scope of this system are connected to a track clear signalling device 24. In this case, the function of the track clear signalling device 24 essentially resides in determining a respective occupancy status of the track sections 11, 12 on the basis of signals that are transmitted by the axle counters 21, 22, 23 or rather on the basis of counter readings and to provide said status to higher ranking systems, possibly in the form of a signal box system or a train control system.

A track-side device 30 in the form of a balise is apparent as a further track-side component in FIG. 1, said track-side component being connected to a track-side electronic unit 31. In this case, it is assumed that the track-side electronic unit 31 is a component that is also described as an LEU (lineside electronic unit) and the track-side device 30 is a balise in the form of a transparent data balise.

Furthermore, FIG. 1 indicates a track-side control device 40 that is intended to be a central control device of a train control system or rather of a train protection system. The track-side control device 40 comprises a communication device 41 by means of which the track-side control device 40 is able to communicate with the rail-borne vehicles that are traveling on the length of track 10. Furthermore, the track-side control device 40 is connected to the track clear signalling device 24.

FIG. 1 illustrates a rail-borne vehicle 50 and in fact in a situation in which the rail-borne vehicle 50 in the form of the railway vehicle is located in the first track section 11 and is moving in a direction of travel 51 toward the second track section 12.

The rail-borne vehicle 50 comprises a vehicle device 52 that comprises a vehicle-side receiving device 53 in the form of a balise antenna, a vehicle-side control device 54 and also a vehicle-side communication device 55. In this case, the vehicle-side control device 54 may be configured by way of example as an on-board unit of a train control system. It is possible by means of the vehicle-side communication device 55 for the vehicle-side control device 54 to transmit information to the track-side control device 40 or rather to receive from said track-side control device relevant information and travel commands, possibly in the form of travel permission or so-called "movement authority".

The track-side device 30, the track-side electronic unit 31, the track-side control device 40, the communications device 41 and the vehicle device 52 together with the vehicle-side receiving device 53, the vehicle-side control device 54 and the vehicle-side communication device 55 form a control device arrangement 60.

According to the illustration in FIG. 1, the rail-borne vehicle 50 is located at the site of the track-side device 30 in such a manner that the vehicle-side device 53 is arranged above the track-side device 30 in the form of the balise and consequently it is possible to transmit information from the track-side device 30 to the vehicle-side receiving device 53.

As is illustrated in FIG. 1, the track-side device 30 is arranged in the first track section 11 at a distance d from the adjacent second track section 12, wherein the distance d is dimensioned such that, in the case of a direction of travel 51 of the rail-borne vehicle from the first track section 11 in the direction toward the second track section 12, the second track section 12 is not occupied by the rail-borne vehicle 50 at the moment the first and the second pieces of information are received. This corresponds precisely to the situation illustrated in FIG. 1 in which the rail-borne vehicle 50 occupies the first track section 11 but not the second track section 12. In contrast, on account of the appropriate arrangement of the track-side device 30, in the case of a direction of travel 51 of the rail-borne vehicle 50 from the second track section 12 in the direction toward the first track section 11, in other words in the direction of travel deviating from the illustration in FIG. 1, the situation would arise that as the vehicle-side receiving unit 53 is positioned over the track-side device 30 not only the first track section 11 but rather in addition also the second track section 12 would be occupied by the rail-borne vehicle 50. As a consequence, it is now advantageously possible that, for the case that according to track clear signalling information the second track section 12 is clear of rail-borne vehicles, the direction of travel 51 of the rail-borne vehicle 50 is ascertained or rather determined.

At this juncture, it is to be emphatically mentioned that the figures merely illustrate schematic sketches for illustrating the exemplary embodiments of the invention with the result that in particular lengths and distances are not illustrated true-to-scale.

As illustrated in FIG. 1, the track-side electronic unit 31 is connected to the track clear signalling device 24 in a manner so as to be able to communicate. As an alternative thereto, the track-side electronic unit may naturally also be connected to another component of the track clear signalling system. The key factor in this respect is merely that track clear signalling information relating to the second track section 12 is available to the track-side electronic unit 31 or rather that said information is transmitted from the track clear signalling system that comprises at least the second track section 12 to the track-side electronic unit 31.

On the basis of the relevant track clear signalling information, the track-side electronic unit 31 causes the track-side device 30 to transmit information or rather a telegram that in addition to a first piece of information that indirectly or directly identifies the location of the track-side device 30 comprises a second piece of information that indirectly or directly identifies the direction of travel 51 of the rail-borne vehicle 50. In the case of the situation illustrated in FIG. 1, the relevant track clear signalling information identifies that the second track section 12 is clear of rail-borne vehicles with the result that the track-side device 30 transmits the second piece of information that identifies a direction of travel 51 of the rail-borne vehicle 50 from the first track section 11 in the direction toward the second track section 12. In this case, the second piece of information may include the direction of travel 51 itself or however by way of example may include information to the effect that the second track section 12 is clear or rather is unoccupied. It is subsequently possible, by way of example using information from an electronic track map, for the rail-borne vehicle 50 or rather the vehicle-side control device 54 of said rail-borne vehicle to determine both the location of the track-side device 30 and also the direction of travel 51 of the rail-borne vehicle 50. By further taking into consideration stored information or data with regard to the distance of the vehicle-side receiving device 53 from the front and also from the rear vehicle end of the rail-borne vehicle 50, it is subsequently possible for the vehicle-side control device 54 to determine the position of the vehicle ends of the rail-borne vehicle 50, where appropriate by taking into consideration tolerances and possible vehicle overhangs.

It is to be noted that in the arrangement of FIG. 1 in addition to the occupancy status of the second track section 12 the track clear signalling system is fundamentally also able to transmit to the track-side electronic unit 31 information with regard to the occupancy status of the first track section 11. In this case, it is consequently possible for the track-side electronic unit 31, the track-side device 30 and/or the vehicle-side control device 54 to perform a plausibility check as to whether the first track section 11 should be flagged as occupied. Should this contrary to expectations not be the case, then it is to be assumed that an error has occurred and the direction of travel 51 of the rail-borne vehicle 50 is to be regarded as undetermined or unknown.

It is to be noted that for the case that the track clear signalling information identifies the second track section 12 as being occupied, it is not automatically ensured that the direction of travel 51 of the rail-borne vehicle 50 has been correctly and clearly determined. Thus, it could be possible for a similar situation to also occur in the case illustrated in FIG. 1 if the second track section 12 were to be occupied by another rail-borne vehicle. In this respect, the described embodiment of the method in accordance with the invention is advantageous in particular in such cases in which the rail-borne vehicles of the rail-borne traffic system generally move exclusively in one direction of travel 51, in other words in such cases in which a unidirectional operation is generally being performed for the respective railway track.

As the procedure progresses, the rail-borne vehicle 50 is able to transmit the position of the at least one vehicle end of the rail-borne vehicle 50 to the track-side control device 40 of the rail-borne traffic system 1. This information may then be taken into consideration by the track-side device 40 when controlling and/or protecting the rail-borne vehicle 50. In the case that the rail-borne vehicle 50 is in the form of a railway vehicle, the track sections 11, 12 are in the form of railway track sections and a track-side control device 40 is in the form of a control device of a communication-based train control system, this may mean in particular that whilst taking into consideration the received information the track-side control device 40 determines movement authority for the rail-borne vehicle 50 and/or causes the rail-borne vehicle 50 to change over into a moving-block operation. As a result, it is consequently possible on the basis of the rapid and reliable manner in which the position of the vehicle ends of the rail-borne vehicle 50 determined to realize a high-performance operation of the rail-borne vehicle 50 or rather of the traffic system 1.

Figure 2:
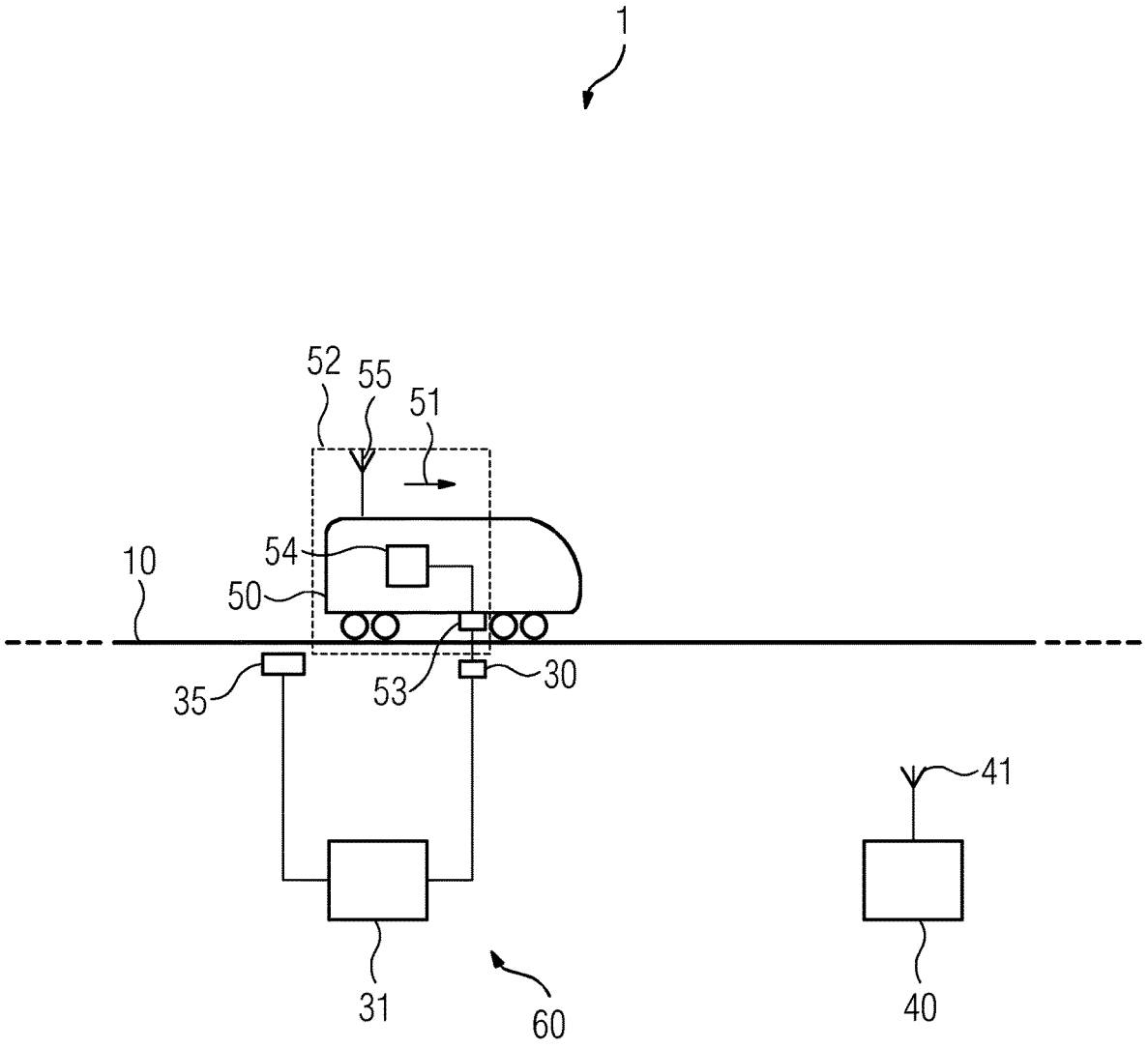

FIG. 2 illustrates in a second schematic sketch for explaining a second exemplary embodiment of the method in accordance with the invention a second exemplary embodiment of the rail-borne traffic system in accordance with the invention having a second exemplary embodiment of the vehicle device in accordance with the invention and also having a second exemplary embodiment of the control device arrangement in accordance with the invention. In this case, the illustration shown in FIG. 2 essentially corresponds to that shown in FIG. 1 but in contrast to FIG. 1 a track clear signalling system is not illustrated or rather is not provided. Accordingly, the length of track 10 is not divided into track sections.

In order now also in this situation to be able to determine the direction of travel 51 of the rail-borne vehicle 50 and thus finally to be able to determine the position at least of one vehicle end of the rail-borne vehicle 50, a rail-side sensor device 35 is provided that is used for the purpose of detecting the direction of travel 51 of the rail-borne vehicle 50. In this case, the track-side sensor device 35 may be by way of example a two-channel wheel sensor, a detection device that functions using photoelectric barriers or also a device arrangement having at least one RFID tag or rather at least one RFID sensor, which is or rather are arranged in such a manner that the detected signals are direction-dependent which renders it possible to determine the direction of travel 51 of the rail-borne vehicle 50.

According to the illustration in FIG. 2, the detected direction of travel 51 is transmitted by the track-side sensor device 35 in such a manner directly to the track-side device 30 that the track-side sensor device 35 transmits the detected travel direction 51 to the track-side electronic unit 31 and said track-side electronic unit in turn causes the track-side device 30 by means of selecting a corresponding telegram to transmit a second piece of information to the rail-borne vehicle 50, said second piece of information comprising indirectly or directly data relating to the direction of travel 51 of the rail-borne vehicle 50.

As an alternative to the embodiment illustrated in FIG. 2, it would naturally also be possible that there is a direct connection between the track-side sensor device 35 and the track-side device 30 and consequently the information relating to the direction of travel 51 of the rail-borne vehicle 50 is transmitted directly to the track-side device 30. Furthermore, it is also possible that the track-side device 30 and the track-side sensor device 35 are configured as a common component.

In accordance with the above mentioned statements in conjunction with the described exemplary embodiments, the method in accordance with the invention and the associated devices render it possible for the vehicle as soon as it passes a single track-side device 30 to determine the position of the vehicle ends of the rail-borne vehicle 50. This is in practice of considerable importance in particular within the scope of starting the operation of the rail-borne vehicle 50 or rather of the rail-borne traffic system 1 or after relevant malfunctions, since as a consequence it is possible to change over into a normal operation as quickly as possible.

The invention claimed is:

1. A method for operating a rail-borne traffic system, which comprises the steps of:

transmitting, via a track-side device, a first piece of information that indirectly or directly identifies a location of the track-side device and also a second piece of information that indirectly or directly identifies a direction of travel of a rail-borne vehicle, the transmitting step including the substeps of:

transmitting the first and second pieces of information by the track-side device which is disposed in a first track section at a distance from an adjacent second track section, wherein the distance is dimensioned such that, in a case of the direction of travel of the rail-borne vehicle from the first track section in a direction toward the second track section, the second track section is not occupied by the rail-borne vehicle at a moment the first and second pieces of information are received, whereas, in a case of the direction of travel of the rail-borne vehicle from the second track section in a direction toward the first track section, the second track section is occupied by the rail-borne vehicle at the moment the first and the second pieces of information are received; and determining the second piece of information on a basis of track clear signalling information in relation to at least the second track section;

receiving the first and second pieces of information by the rail-borne vehicle at the location of the track-side device; and determining a position of at least one vehicle end of the rail-borne vehicle on a basis of the first and second pieces of information received.

2. The method according to claim 1, which further comprises transmitting the first and second pieces of information by the track-side device being a balise.

3. The method according to claim 1, wherein the track clear signalling information identifies that the second track section is clear of rail-borne vehicles and on a basis thereof the track-side device transmits the second piece of information that indicates the direction of travel of the rail-borne vehicle from the first track section in the direction toward the second track section.

4. The method according to claim 1, which further comprises transmitting the track clear signalling information by a track clear signalling system that has at least the second track section to a track-side electronic unit and the track-side electronic unit causes the track-side device to transmit the second piece of information.

5. The method according to claim 4, wherein the first and second track sections of the track clear signalling system have axle counters or railway track circuits.

6. The method according to claim 1, which further comprises:

detecting the direction of travel of the rail-borne vehicle by a track-side sensor; and transmitting the direction of travel detected indirectly or directly to the trackside device by the track-side sensor.

7. The method according to claim 1, which further comprises transmitting, via the rail-borne vehicle, the position of the at least one vehicle end to a track-side controller of the rail-borne traffic system.

8. The method according to claim 7, which further comprises taking the position of the at least one vehicle end of the rail-borne vehicle into consideration by the track-side controller when controlling and/or protecting the rail-borne vehicle.

9. The method according to claim 7, wherein in a case of the rail-borne vehicle being a railway vehicle, the first and second track sections being in a form of railway track sections and the track-side controller being a control device of a communication-based train control system, while taking into consideration the position of the at least one vehicle end of the rail-borne vehicle the track-side controller determines movement authority for the rail-borne vehicle and/or causes the rail-borne vehicle to change over into a moving-block operation.

10. A control device configuration for a rail-borne traffic system, the control device configuration comprising:

a track-side device;

a vehicle device containing:

a vehicle-side receiver for receiving a first piece of information that indirectly or directly identifies a location of said track-side device and also a second piece of information that indirectly or directly identifies a direction of travel of a rail-borne vehicle from said track-side device; and a vehicle-side controller for determining a position of at least one vehicle end of the rail-borne vehicle on a basis of the first and second pieces of information received; and said track-side device configured to transmit the first piece of information that indirectly or directly identifies the location of said track-side device and also the second piece of information that indirectly or directly identifies the direction of travel of the rail-borne vehicle, said track-side device is disposed in a first track section at a distance from an adjacent second track section, wherein the distance is dimensioned such that, in a case of the direction of travel of the rail-borne vehicle from the first track section in a direction toward the second track section, the second track section is not occupied by the rail-borne vehicle at a moment the first and the second pieces of information are received, whereas, in a case of the direction of travel of the rail-borne vehicle from the second track section in the direction toward the first track section, the second track section is occupied by the rail-borne vehicle at a moment the first and the second pieces of information are received; and the control device configuration is configured so as to determine the second piece of information on a basis of track clear signalling information in relation to at least the second track section.

11. The control device configuration according to claim 10, wherein said track-side device is a balise.

12. The control device configuration according to claim 10, wherein the track clear signalling information identifies that the second track section is clear of rail-borne vehicles and said track-side device is configured so as to transmit the second piece of information that indicates the direction of travel of the rail-borne vehicle from the first track section in the direction toward the second track section.

13. The control device configuration according to claim 12, further comprising:

a track-side electronic unit for receiving the track clear signalling information from a track clear signalling system that contains at least the second track section; and said track-side electronic unit causing said track-side device to transmit the second piece of information.

14. The control device configuration according to claim 10, further comprising a track-side sensor for detecting the direction of travel of the rail-borne vehicle and the control device configuration is configured in such a manner that said track-side sensor transmits the direction of travel detected indirectly or directly to said track-side device.

15. The control device configuration according to claim 10, wherein the control device configuration is configured to:

transmit, via said track-side device, the first piece of information that indirectly or directly identifies the location of said track-side device and also the second piece of information that indirectly or directly identifies the direction of travel of the rail-borne vehicle;

receive the first and second pieces of information by the rail-borne vehicle at the location of said track-side device;

determine the position of at least one vehicle end of the rail-borne vehicle on a basis of the first and second pieces of information received; and transmit, via the rail-borne vehicle, the position of the at least one vehicle end to a track-side control unit of a rail-borne traffic system.

* * * * *